US007699632B2

(12) United States Patent
Hiramatsu

(10) Patent No.: US 7,699,632 B2
(45) Date of Patent: Apr. 20, 2010

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/250,595

(22) Filed: Oct. 14, 2008

(65) Prior Publication Data

US 2009/0111301 A1 Apr. 30, 2009

(30) Foreign Application Priority Data

Oct. 29, 2007 (JP) ..... 2007-279739

(51) Int. Cl.
*H01R 13/64* (2006.01)

(52) U.S. Cl. ..... 439/246; 439/378

(58) Field of Classification Search ..... 439/246, 439/249, 374, 375, 378, 380, 381
See application file for complete search history.

(56) References Cited

U.S. PATENT DOCUMENTS 5,425,650 A * 6/1995 Maeda ..... 439/374
5,584,721 A * 12/1996 Taniuchi et al. ..... 439/374
6,413,114 B2 * 7/2002 Fukamachi ..... 439/374
6,475,014 B2 * 11/2002 Tsuji et al. ..... 439/352
6,767,239 B2 * 7/2004 Fukamachi ..... 439/378
7,267,562 B2 * 9/2007 Katsuma ..... 439/140
2003/0096528 A1 * 5/2003 Fukamachi ..... 439/378
2004/0102077 A1 * 5/2004 Shibata ..... 439/374
2006/0205264 A1 * 9/2006 Katsuma ..... 439/381
2009/0035976 A1 * 2/2009 Matsunaga ..... 439/271
2009/0111301 A1 * 4/2009 Hiramatsu ..... 439/133

FOREIGN PATENT DOCUMENTS

JP 2003-151682 5/2003

* cited by examiner

*Primary Examiner*—James Harvey
(74) *Attorney, Agent, or Firm*—Gerald E. Hespos; Michael J. Porco

(57) ABSTRACT

A prevention part projected forward from a rear-end surface of a hood part (12) has a first prevention piece (61) disposed within a region of a rear-end surface of the hood part (12) from which a plurality of tabs (22) is projected; and a pair of second prevention pieces (62) so disposed as to sandwich the first prevention piece (61) therebetween, with the second prevention pieces (62) and the first prevention piece (61) arranged in a row at certain intervals. The tabs (22) are disposed between the first prevention piece (61) and the second prevention pieces (62). This construction is capable of decreasing a tab-disposing region.

17 Claims, 9 Drawing Sheets

CONNECTOR

BACKGROUND OF THE INVENTION

1. Field of the Invention

The invention relates to a connector.

2. Description of the Related Art

Japanese Patent Application Laid-Open No. 2003-151682 discloses a connector with a terminal accommodation part. A hood extends forward from the terminal accommodation part and receives a mating connector. Tabs of the male terminal fittings project from the terminal accommodation part and are surrounded by the hood. A plate-shaped prevention part projects from the rear-end surface of the hood towards the open portion to prevent an obliquely aligned mating connector from interfering with the tabs as the mating connector is advanced into the hood.

The tabs of the above-described connector are disposed vertically and horizontally on the rear end of the hood. The prevention part is long and extends continuously to divide the tabs into first and second groups so that the first-group tabs, the prevention part and the second-group tabs are arranged sequentially on the rear end of the hood. The rear end of the hood is widened to secure the region in which the prevention part is separate from the tab-disposing region. The formation of the prevention part on the rear end of the hood causes the connector to be large.

The invention has been completed in view of the above-described situation. Therefore it is an object of the invention to form a prevention part on a rear end of a hood without making the connector large.

SUMMARY OF THE INVENTION

The invention relates to a connector having a housing with a terminal accommodation part and a hood that extends forward from the terminal accommodation part. Male terminal fittings are held by the terminal accommodation part so that tabs of the male terminal fittings project forward from a rear-end surface of the hood. A prevention part projects forward from the rear-end surface of the hood to ensure that a mating connector that has advanced into the hood in an improper oblique posture does not contact the tabs. In this construction, the prevention part has a first prevention piece disposed in a region of a rear-end surface of the hood from which a plurality of the tabs project; and two second prevention pieces on opposite side of the first prevention piece, with the second prevention pieces and the first prevention piece arranged in a row at certain intervals. The tabs are disposed between the first and second prevention pieces. Thus, tabs are disposed in the region where the prevention part is formed to decrease the tab-disposing region. Accordingly, the connector can be smaller than a connector in which the prevention part is continuously formed.

The second prevention pieces preferably are formed integrally with an inner peripheral surface of the hood. Thus, the second prevention pieces have a high rigidity and there is no fear that a pressing force applied by the mating connector will not deform the second prevention pieces.

When the mating connector has advanced into the hood in an inclined posture, the corner of the mating connector that advances deeper than other portions is disposed at the central region of the hood. Accordingly, the first prevention piece is disposed in a region including the central position of the hood in a direction in which the first and second prevention pieces are arranged. Thus it is possible to restrain the advance distance of the mating connector can be advanced obliquely into the hood is minimized.

The first prevention piece preferably is plate-shaped. However, a plate-shaped piece could lack rigidity. Accordingly, a reinforcing rib preferably is formed on the first prevention piece to enhance the rigidity of the first prevention piece. Therefore, the first prevention piece more securely prevents the mating connector from advancing into the hood in an improper posture.

The prevention part preferably includes a third prevention piece at a position spaced from the first and second prevention pieces in a direction intersecting the direction in which the first and second prevention pieces are arranged. The third prevention piece is disposed in the region including the central position of the hood in the direction in which the first and second prevention pieces are arranged. The third prevention piece reliably prevents the advance of the mating connector into the hood.

The tabs preferably are disposed between the third prevention piece and the inner peripheral surface of the hood. Therefore, the area required for the other tabs is decreased.

The third prevention piece preferably is plate-shaped. However, a plate-shaped piece could lack rigidity. Accordingly, a reinforcing rib preferably is formed on the third prevention piece to enhance the rigidity of the third prevention piece. Therefore, the third prevention piece more securely prevents the mating connector from advancing into the hood in an improper posture.

The mating connector preferably is fit in the hood due to a cam action caused by rotation of a lever. Hence, the mating connector is likely to incline with respect to the hood about the rotational center of the lever while fitting the mating connector in the hood. Accordingly, the first and third prevention pieces preferably are spaced in the direction perpendicular to the rotational center of the lever and securely prevent the mating connector from inclining.

A front retainer for preventing removal of the male terminal fittings preferably is mounted on a front-end surface of the terminal accommodation part and the first prevention piece preferably is formed integrally with the front retainer. Therefore, the configuration of the housing is simplified as compared with a construction in which the third prevention piece is formed integrally with the front surface of the terminal accommodation part.

DETAILED DESCRIPTION OF THE PREFERRED EMBODIMENTS

Figure 1:
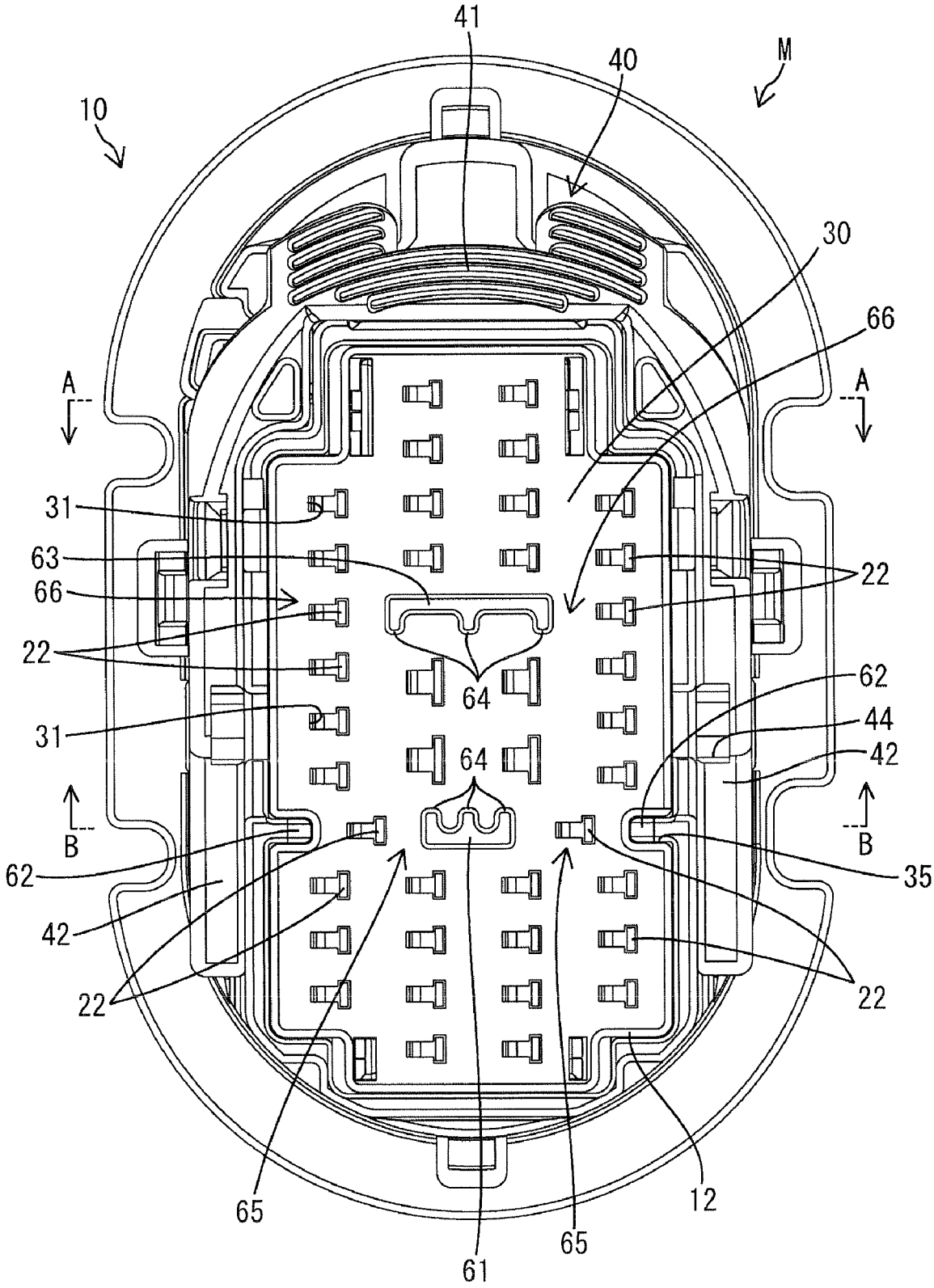
FIG. 1 is a front view showing a male connector of the invention.
Figure 2:
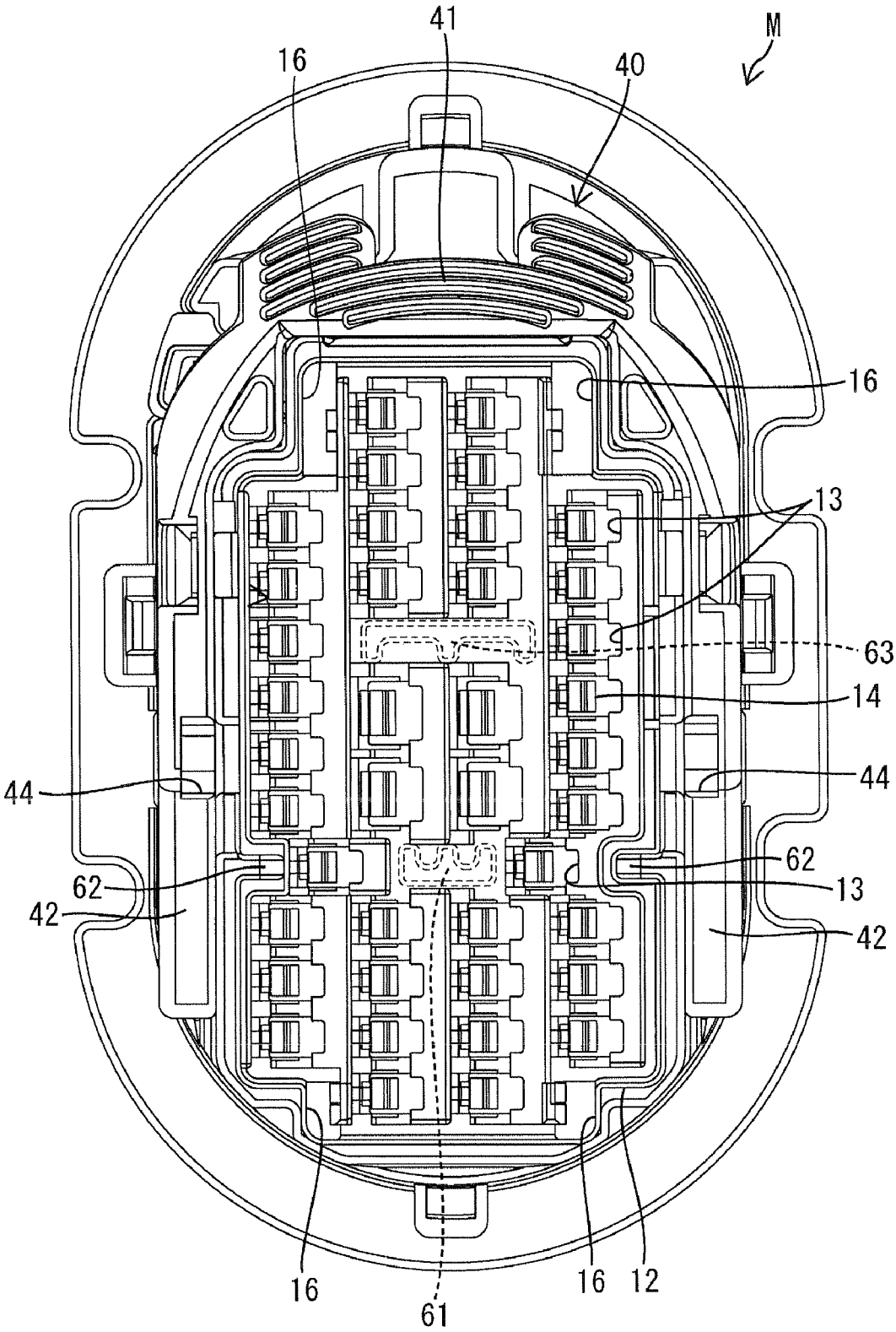
FIG. 2 is a front view of the male connector showing a state in which a front retainer is removed from the male connector.

A male connector in accordance with the invention is identified by the letter M in FIGS. 1 through 9 and can be fit on a female connector F. The male connector M includes a male housing 10, a plurality of male terminal fittings 20, a front retainer 30 and a lever 40.

The male housing 10 is made of synthetic resin and includes a long narrow block-shaped terminal accommodation part 11 and a hood 12 that extends forward from a peripheral edge of the terminal accommodation part 11. The terminal accommodation part 11 and the hood 12 are formed unitarily with each other. Cavities 13 penetrate longitudinally through the terminal accommodation part 11 at predetermined positions in vertical and left-to-right directions. A lance 14 is cantilevered forward along an inner wall of each cavity 13, as shown in FIGS. 3 and 4, and a flexible space 15 is open on a front-end surface of the terminal accommodation part 11 to permit elastic flexure of the lance 14.

Four locking holes 16 are formed inside the terminal accommodation part 11 for holding the front retainer 30. The four locking holes 16 are disposed at left and right ends of each of upper and lower ends of the front-end surface of the terminal accommodation part 11. A temporary lock 17 and a main lock 18 are formed on an inner wall surface of each locking hole 16, as shown in FIG. 3.

The hood 12 is a vertically long tube and has upper and lower walls and left and right side walls. Supporting shafts 19 project from an outer surface of each of the left and right side walls of the hood 12 so that the axes of the supporting shafts 19 extend in the left-to-right direction.

Figure 3:
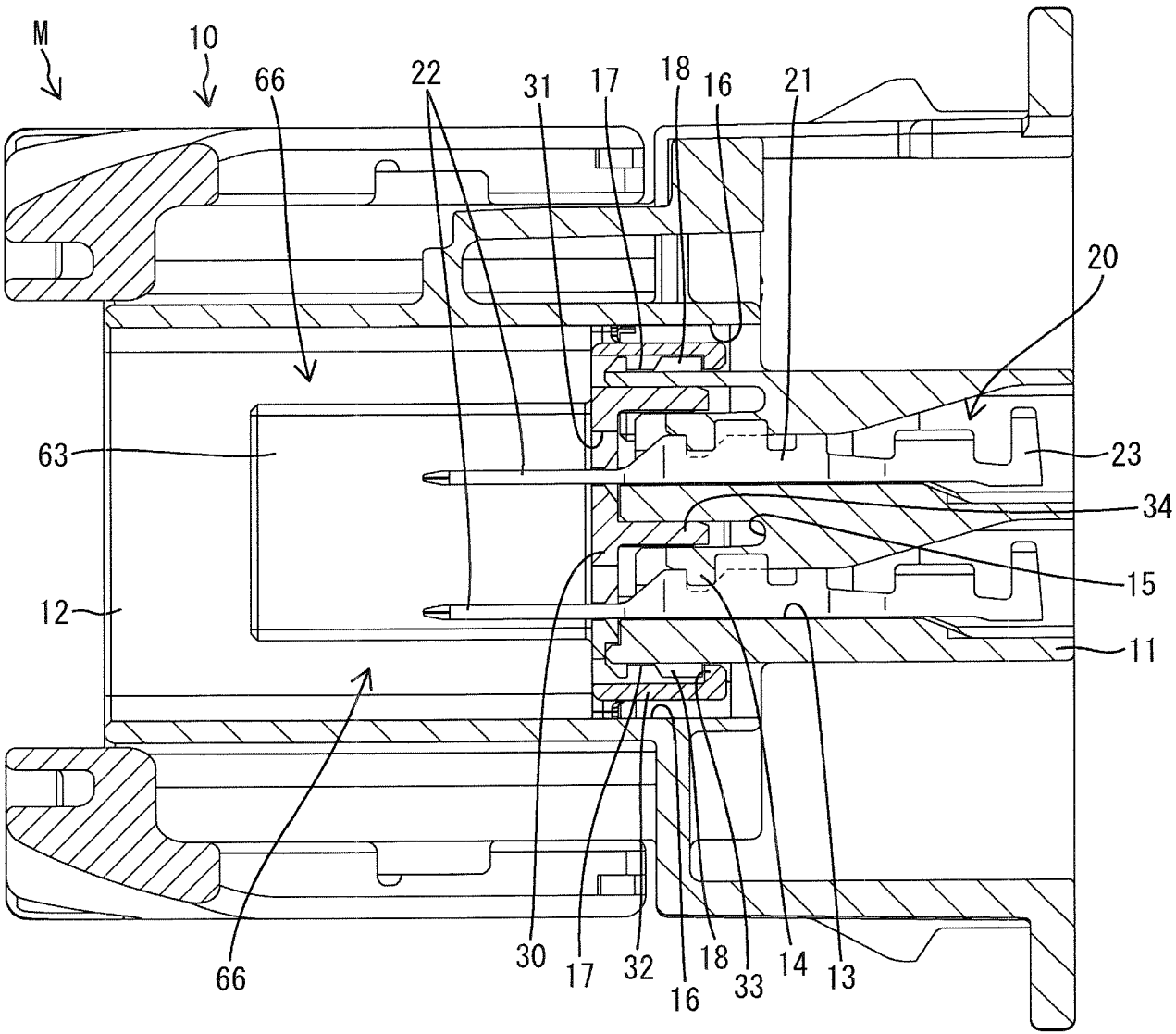
FIG. 3 is a sectional view taken along a line A-A of FIG. 1.
Figure 4:
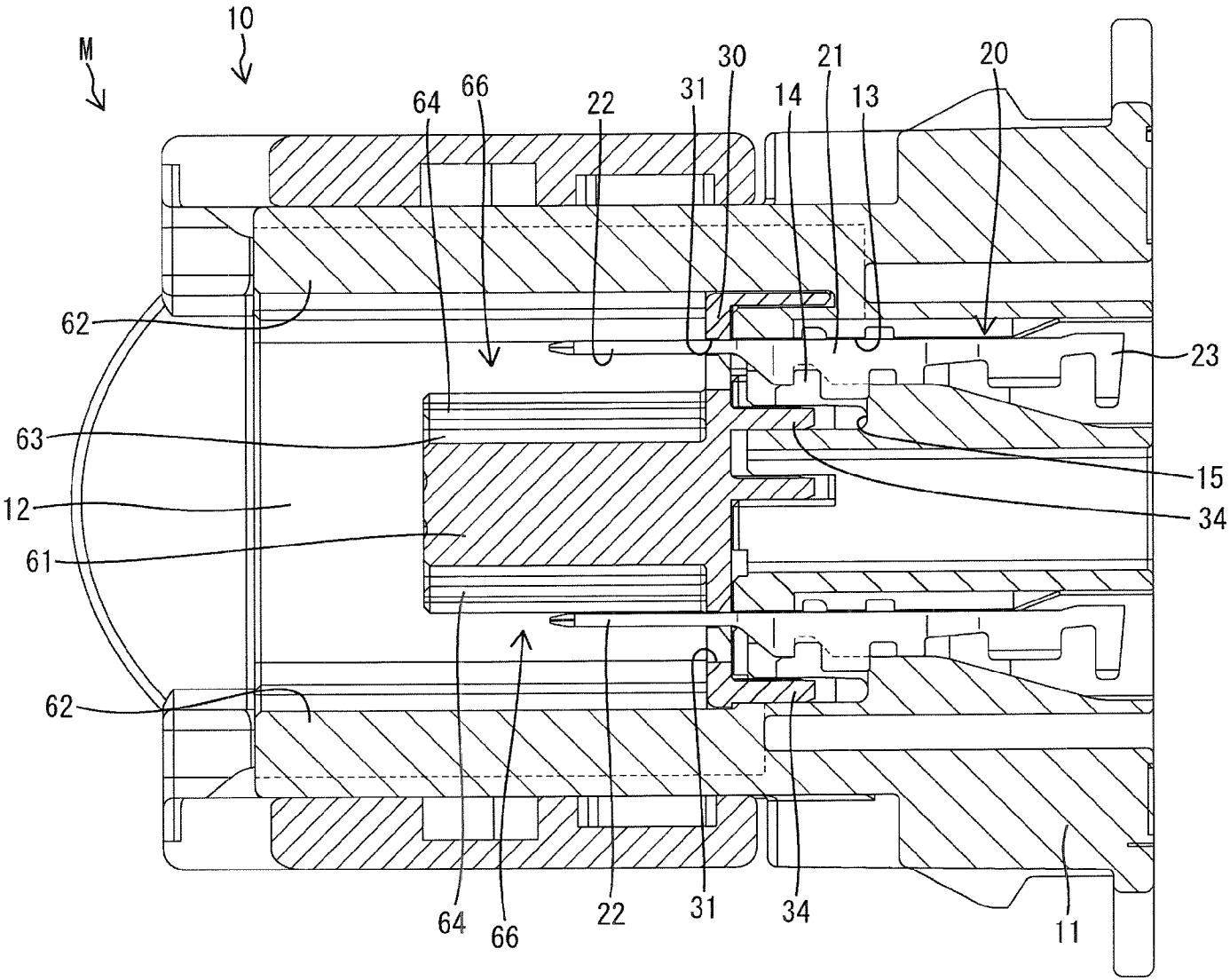
FIG. 4 is a sectional view taken along a line B-B of FIG. 1.

Each male terminal fitting 20 has a long narrow main body 21 with a square pillar shape, as shown in FIGS. 3 and 4, and a lance hole (not shown) is formed through the main body 21. A tab 22 projects unitarily forward from a front end of the main body 21 and an electric wire contact bonding portion 23 extends unitarily rearward from the main body 21. An electric wire (not shown) is connected with the electric wire contact bonding portion 23. The male terminal fittings 20 are inserted into the respective cavities 13 from the rear end of the male housing 10 and cause the lances to flex 14 to flex elastically into the respective flexible spaces 15. The lances 14 elastically return to a normal state when the male terminal fittings 20 are inserted into the cavities 13 to a normal state, thereby locking the male terminal fittings 20. The tabs 22 project forward from the front-end of the terminal accommodation part 11 and into a fit-in space surrounded by the hood 12 when the male terminal fittings have been inserted into the respective cavities 13 to the normal state.

The front retainer 30 is made of synthetic resin and defines a flat plate parallel with the front-end surface of the terminal accommodation part 11. Through-holes 31 extend through the front retainer 30 for receiving the tabs 22 and a jig (not shown) may be inserted therein from the front end of the front retainer 30. Four elastic locks 32 project rearward from left and right side edges of upper and lower ends of the front retainer 30. Each elastic lock 32 is capable of elastically flexing sideways. As shown in FIG. 3, a locking projection 33 is formed at a rear projected end of each elastic lock 32. An engaging piece 34 projects rearward from the front retainer 30, as shown in FIGS. 3 and 4, and is capable of advancing into the flexible space 15 of the terminal accommodation part 11.

Figure 5:
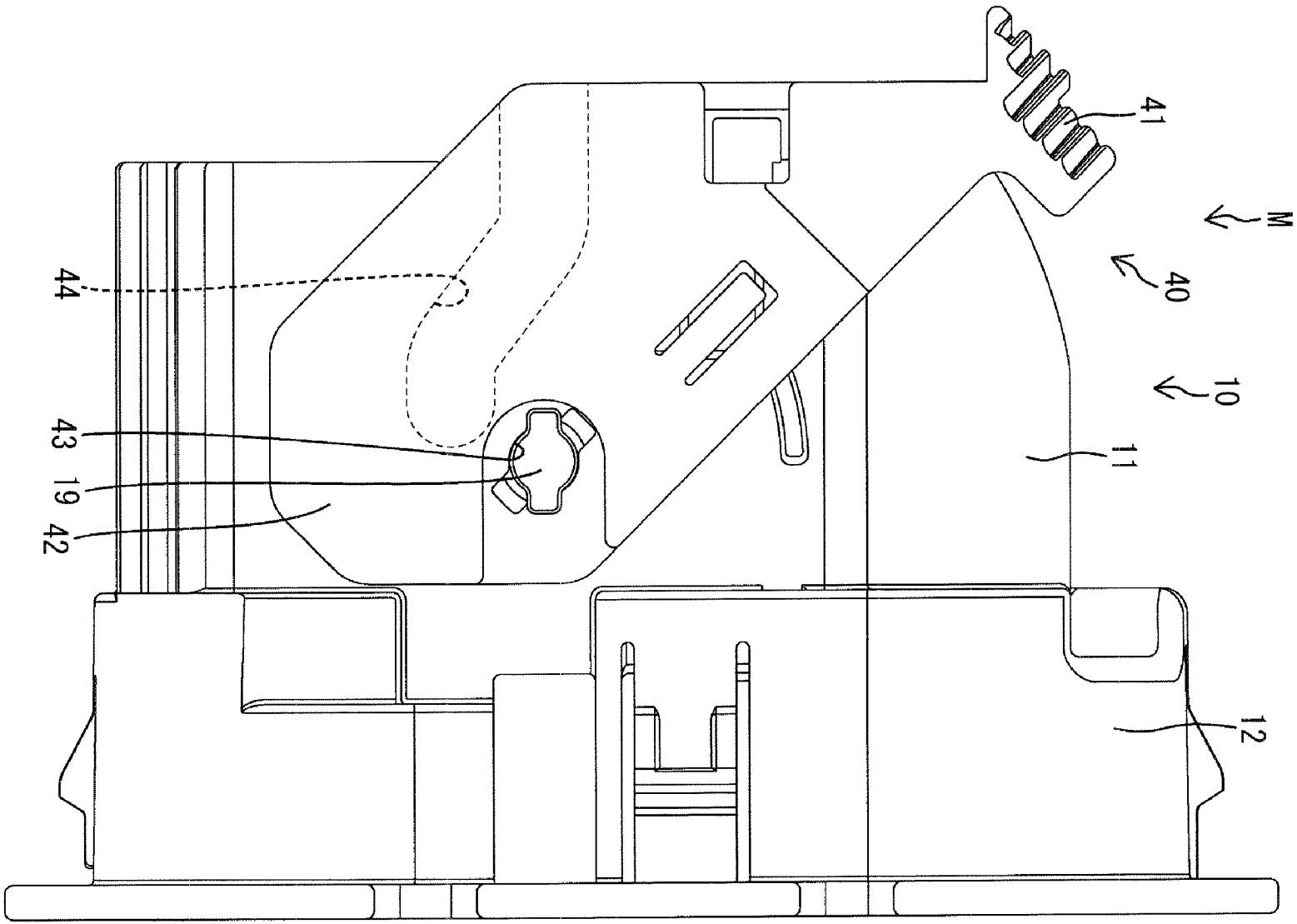
FIG. 5 is a side view of the male connector showing a state in which a lever is located at an initial position.

The lever 40 is made of synthetic resin and has an operation part 41 and plate shaped arms 42 that extend unitarily from left and right ends of the operation part 41, as shown in FIG. 5. A bearing hole 43 penetrates through each arm 42 in the left-to-right direction and a cam groove 44 is formed on an inner surface of the arm 42. The cam grooves 44 extend from peripheral edges of the arms 42 towards the bearing hole 43 obliquely to the direction of the radii of a circle whose center is disposed at the bearing hole 43. The cam grooves 44 are rotatable between an initial position and a fit-in position by fitting the supporting shaft 19 in the bearing hole 43 with the arm 42 disposed along the outer surface of the left and right side walls of the hood 12. An ingress of the cam groove 44 faces a peripheral edge of the cam groove 44 and is disposed to open forward when the lever 40 is at the initial position.

The front retainer 30 is inserted into the hood 12 from the front end of the male housing 10 so that the elastic lock 32 of the front retainer 30 fits in the locking hole 16 of the terminal accommodation part 11. The locking projection 33 then engages the temporary lock 17 to mount the front retainer 30 on the male housing 10 at a temporary locking position with the rear surface of the front retainer 30 forward of the front-end surface of the terminal accommodation part 11. The peripheral edge of the front retainer 30 is in the inner peripheral surface of the hood 12 so that movement of the front retainer 30 is prevented in vertical and left-to-right directions relative to the housing 10 (perpendicular to the insertion direction of the male terminal fittings 20). At this time, the engaging piece 34 of the front retainer 30 is forward of the flexible space 15 of the terminal accommodation part 11 so that the lance 14 can flex elastically towards the flexible space 15.

The male terminal fittings 20 then are inserted into the respective cavities 20 from the rear end of the male housing 10. Thus, the main bodies 21 of the male terminal fittings 20 engage the lances 14 and cause the lances 14 to flex elastically towards the flexible space 15. The lances 14 elastically return to the original state and enter the lance holes when the respective male terminal fittings 20 reach a predetermined normal insertion position to hold the male terminal fittings 20 in the removal prevention state. The tabs 22 project forward from the front-end surface of the terminal accommodation part 11 in the fit-in space surrounded by the hood 12. The penetration of the tabs 22 through the through-holes 31 of the front retainer 30 prevent the tabs 22 from moving in the vertical and left-to-right directions relative to the front retainer 30.

The front retainer 30 is pressed from the front end of the male housing 10 after all of the male terminal fittings 20 are inserted fully into the cavities 20 and is moved to the main locking position. The locking projection 33 of the elastic lock 32 is locked to the main locking portion 18 when the front retainer 30 is at the main locking position, as shown in FIG. 3. Thus, the front retainer 30 is held at the main locking position, and the engaging pieces 34 advance into the respective flexible spaces 15, as shown in FIGS. 3 and 4, to prevent elastic flexure of the lances 14. Accordingly, the male terminal fittings 20 are held securely in the cavities 13 due to the double locking by the lances 14 and the front retainer 30. The front retainer 30 at the main locking position contacts the front-end of the terminal accommodation part 11. In this state, the front surface of the front retainer 30 aligns with a rear-end surface of the hood 12.

Figure 6:
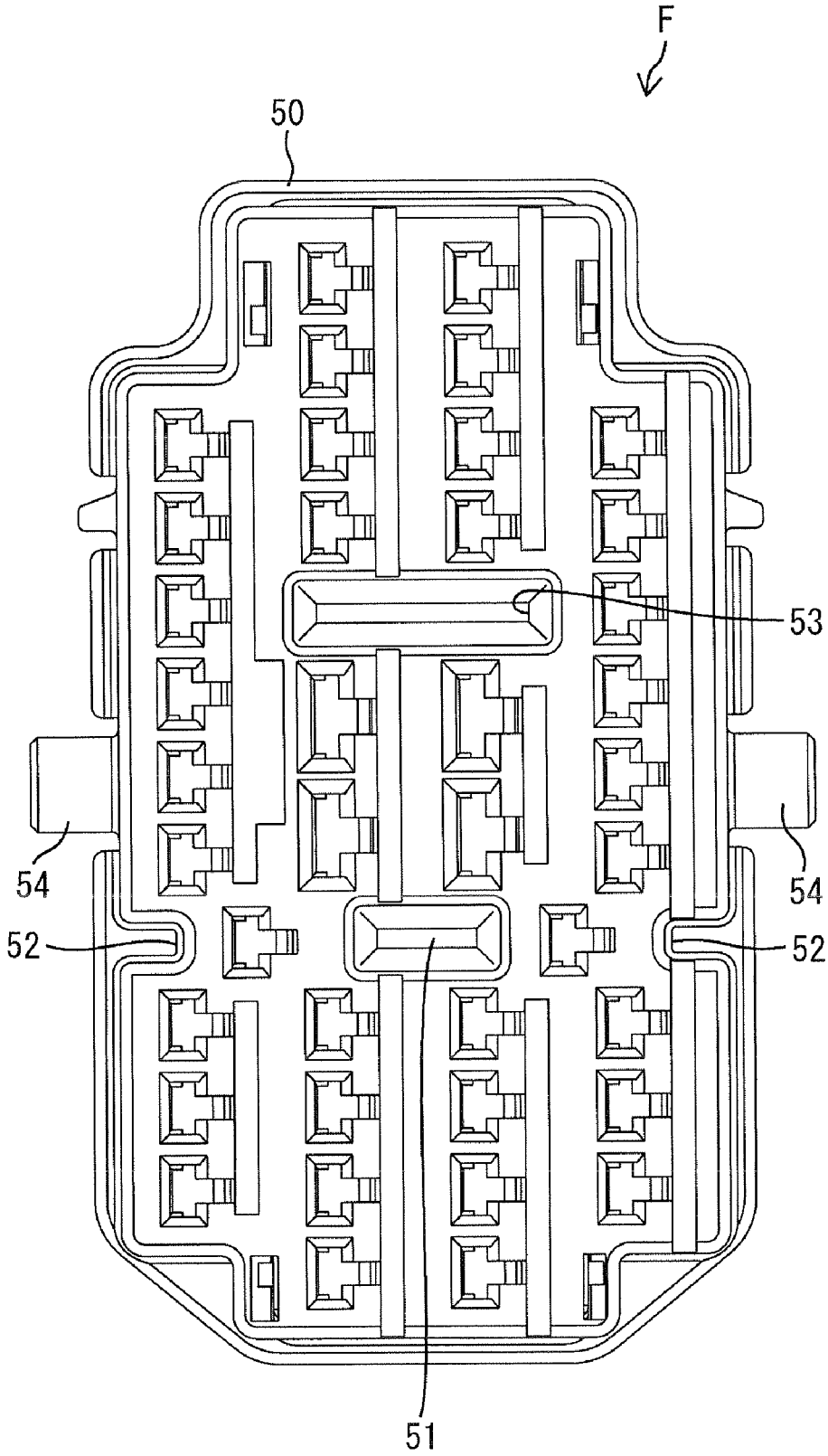
FIG. 6 is a front view of a female connector.
Figure 7:
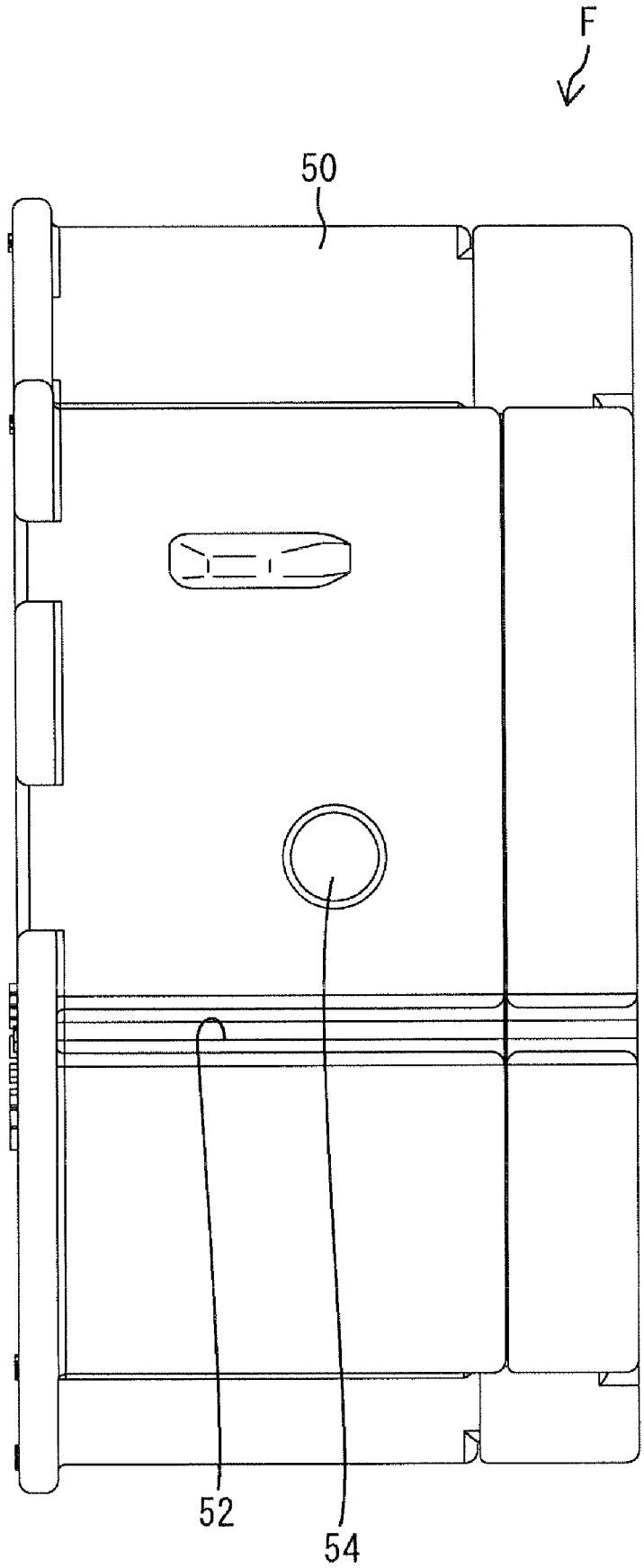
FIG. 7 is a side view of the female connector.

The female connector F has a block-shaped female housing 50, as shown in FIGS. 6 and 7, and female terminal fittings of known form are inserted into the female housing 50. Cam followers 54 project from left and right outer surfaces of the female housing 50. First and third wide slit-shaped positioning concavities 51 and 53 are formed in the front end surface the female housing 50 and face the terminal accommodation part 11 when the female housing 50 is fit in the male connector M. The female housing 50 also has two second positioning concavities 52 formed by cutting out left and right outer surfaces thereof in the shape of long slits.

Figure 8:
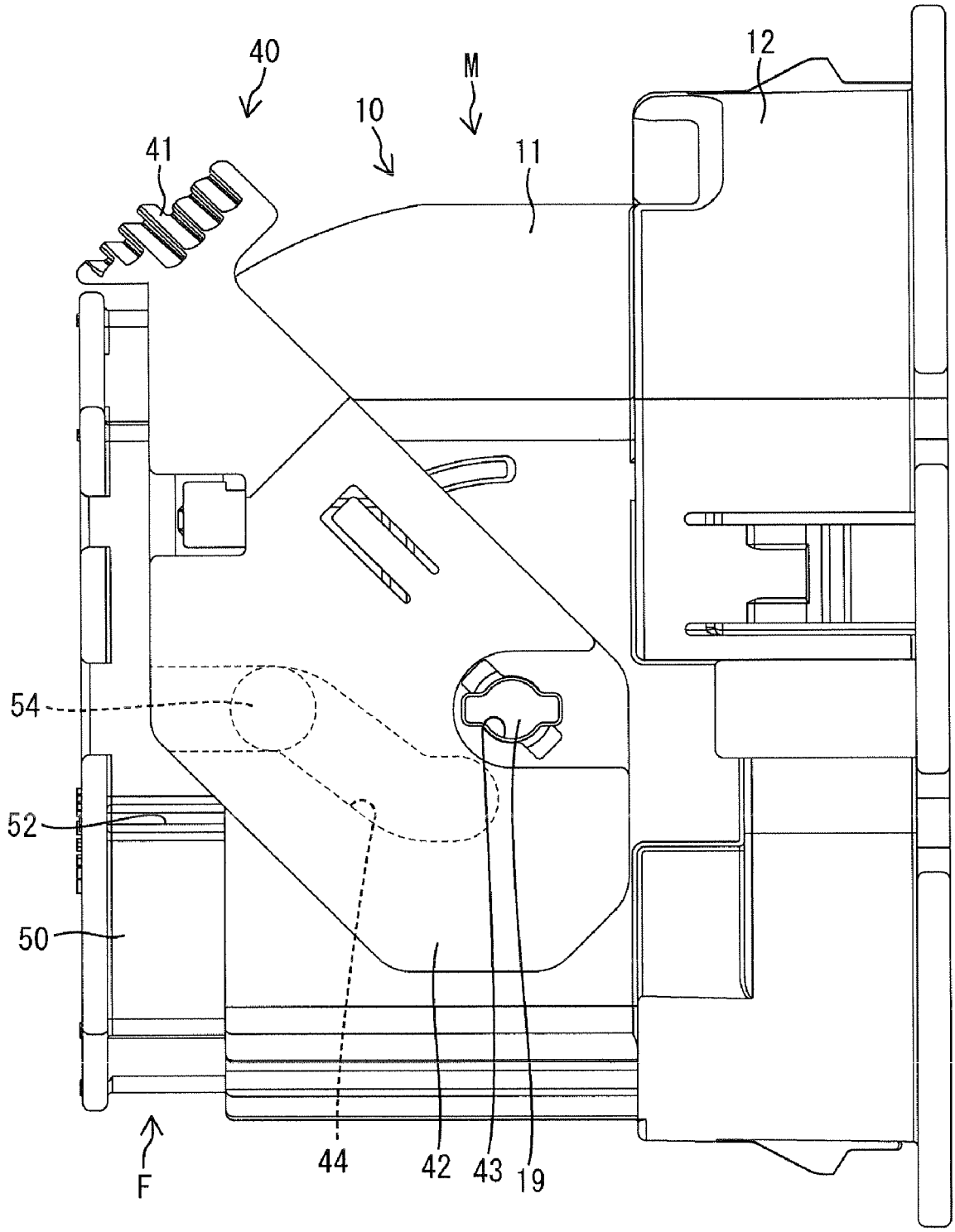
FIG. 8 is a side view showing the process of fitting the female connector in the male connector.
Figure 9:
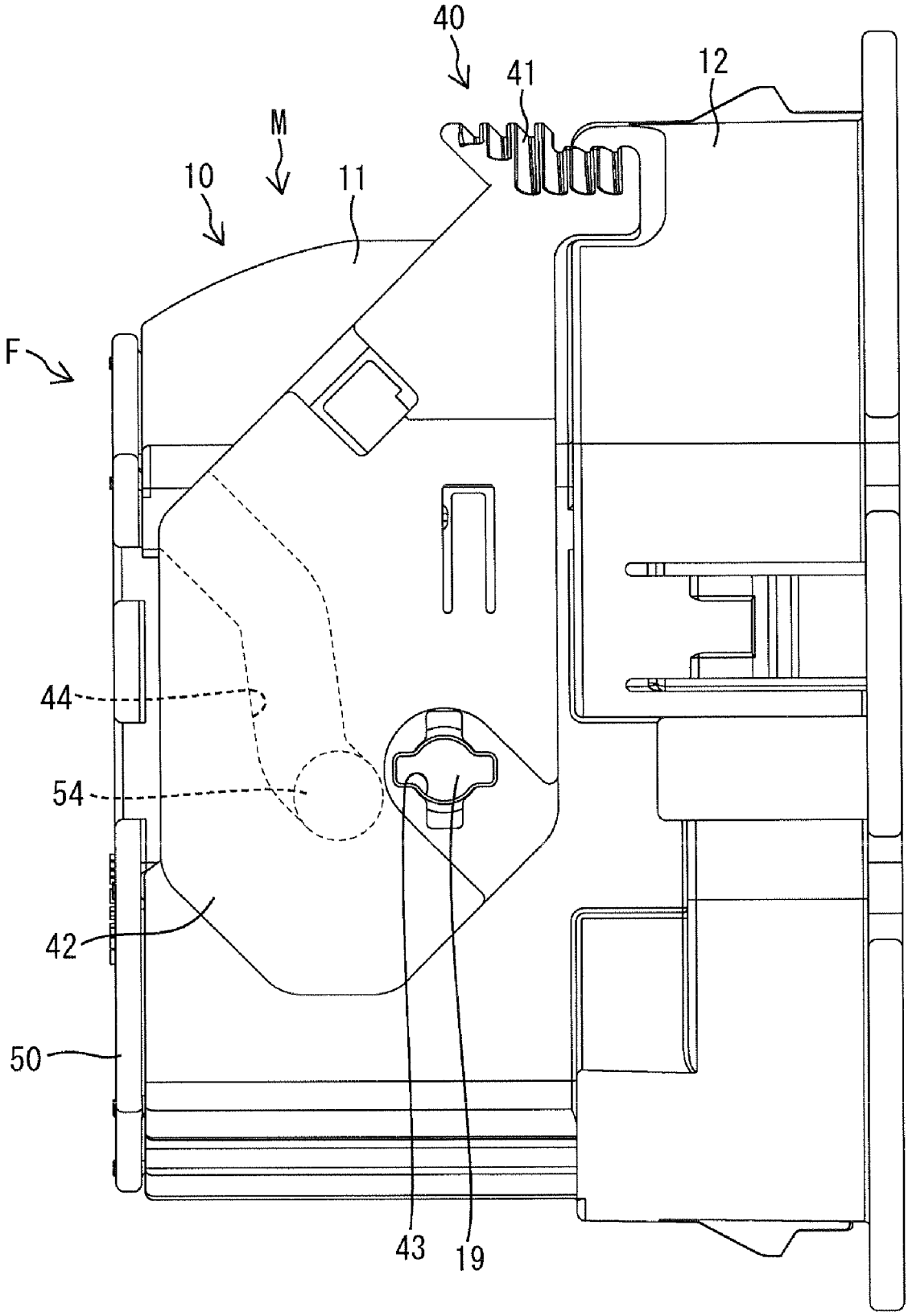
FIG. 9 is a side view showing a state in which the female connector has been fit in the male connector.

The female and male connectors F and M are fit together by holding the lever 40 at the initial position so that the ingress of the cam functioning portion 44 opens forward, as shown in FIG. 5. In that state, the female housing 50 is fit in the hood 12 from the front of the male housing 10 to move the cam follower 54 into the ingress of the cam functioning portion 44, as shown in FIG. 8. The lever 40 is rotated to a fit-in completion position by gripping the operation part 41. As a result, a cam action caused by engaging the cam functioning portion 44 with the cam follower 54 draws the female connector F to the male connector M. The connectors M, F reach the predetermined normal fit-in state when the lever reaches the fit-in completion position, as shown in FIG. 9.

The male connector M has a prevention part to prevent the female housing 50 from interfering with the tabs 22 in the hood 12, when the female housing 50 is fit in the hood 12 in an improper posture. The prevention part has a first prevention piece 61 formed unitarily with the front retainer 30, two second prevention pieces 62 formed unitarily with the hood 12, and a third prevention piece 63 formed unitarily with the front retainer 30.

As shown in FIG. 1, the first prevention piece 61 is a horizontal plate that projects perpendicularly forward from the front surface of the front retainer 30, and hence parallel with the normal mounting direction of the front retainer 30 for the hood 12. The first prevention piece 61 is on the front surface of the front retainer 30 at a position about ⅓ the distance from the lower end of the front surface thereof in the vertical direction and at a central portion in the left-to-right direction.

The width of the first prevention piece 61 in the left-to-right direction is about ¼ of the dimension of the hood 12 in the width direction. The first prevention piece 61 projects forward from the front retainer 30 by about ⅔ of the depth of the hood 12. The front end of the first prevention piece 61 is forward from the front ends of the tabs 22 and rearward from an open surface of the hood 12. Three reinforcing ribs 64 project from an upper surface of the first prevention piece 61 and are spaced from one another in the left-to-right direction. The three reinforcing ribs 64 are located along left and right edges of the first prevention piece 61 and at a central position of the first prevention piece 61 in the left-to-right direction. Additionally, the three reinforcing ribs 64 are continuous over the full length of the first prevention piece 61 from the rear end to a projected end thereof.

The second prevention pieces 62 are unitary with the inner surface of the left and right side walls of the hood 12 and extend continuously from the front-end surface of the terminal accommodation part 11 to the open front end of the hood 12. Each second prevention piece 62 is a rib that extends forward from the rear end of the hood 12 and is aligned parallel with the first and third prevention pieces 61 and 63. Portions of each second prevention piece 62 disposed on the rear-end surface of the hood 12 are vertically on a level with the first prevention piece 61. Additionally, the first prevention piece 61 is sandwiched between the left and right second prevention pieces 62 in the left-to-right direction. The second prevention pieces 62 and the first prevention piece 61 are arranged horizontally in a row at certain intervals.

The dimension of the second prevention piece 62 from the inside of the hood 12 of the second prevention piece 62 in the left-to-right direction is smaller than the dimension of the first prevention piece 61 in the left-to-right direction. Two lower disposing spaces 65 are formed between the first prevention piece 61 and the left and right second prevention pieces 62 in the left-to-right direction in FIG. 1. Each lower disposing space 65 is wider than the first prevention piece 61 in the left-to-right direction thereof. An escape groove 35 for avoiding interference between the second prevention piece 62 and the front retainer 30 is formed at left and right side edges of the front retainer 30.

The third prevention piece 63, like the first prevention piece 61, is a horizontal plate that projects perpendicularly forward from the front surface of the front retainer 30 parallel with the tab 22. The third prevention piece 63 is spaced about ⅓ from the upper end of the front surface of the front retainer 30 in the vertical direction and at a central portion in the left-to-right direction. The third prevention piece 63 is wider than the first prevention piece 61 and defines a width in the left-to-right direction that is about ⅓ of the dimension of the hood 12 in the left-to-right direction. The third prevention piece 63 projects forward from the front retainer 30 by about ⅔ of the depth of the hood 12. The front end of the third prevention piece 63 is forward from the front ends of the tabs 22 and rearward from the open surface of the hood 12. The projected dimension of the third prevention piece 63 is equal to that of the first prevention piece 61.

Three reinforcing ribs 64 project from a lower surface of the third prevention piece 63 and are spaced from one another in the left-to-right direction. The three reinforcing ribs 64 are located along left and right edges of the third prevention piece 63 and at a central position thereof. Additionally, the three reinforcing ribs 64 are continuous over the full length of the third prevention piece 63 from the rear end to a projected front end. Two upper disposing spaces 66 extend in the left-to-right direction in FIG. 1 between the third prevention piece 63 and the inner surface of the hood 12. Each upper disposing space 66 is slightly narrower than the third prevention piece 63 in the left-to-right direction. The dimension of the upper disposing space 66 in the left-to-right direction thereof is almost equal to the dimension of the lower disposing space 65 in the left-to-right direction.

Most of the tabs 22 that project forward from the rear-end surface of the hood 12 are disposed vertically in four rows. The region where the tabs 22 are disposed is partitioned into an upper disposing region, a central disposing region and a lower disposing region. An upper boundary line is formed by the third prevention piece 63 in the left-to-right direction and a lower boundary line is formed by the first prevention piece 61 and the second prevention piece 62 in the left-to-right direction.

Two lower disposing spaces 65 are disposed on the lower boundary line between the first prevention piece 61 and each of the left and right second prevention pieces 62. One tab 22 is disposed in each of the lower disposing spaces 65 at positions shifted from the tabs 22 disposed upwardly and downwardly adjacent thereto in the left-to-right direction.

Two upper disposing spaces 66 are disposed on the lower boundary line, with the third prevention piece 63 sandwiched between the left upper disposing space 66 and the right upper disposing space 66. One tab 22 is disposed in each of the upper disposing spaces 66 at positions coincident with the tabs 22 disposed upwardly and downwardly adjacent thereto in the left-to-right direction. That is, the tabs 22 disposed at the left and right ends of the upper disposing region, the tabs 22 disposed at the left and right ends of the central disposing region, and the tabs 22 disposed in the upper disposing space 66 are arranged vertically in a row without being shifted in the left-to-right direction.

The female housing 50 can be fit in the hood 12 in a predetermined normal posture without trouble, with the first prevention piece 61 being fit in the first positioning concavity 51, the second prevention piece 62 being fit in the second positioning concavity 52, and the third prevention piece 63 being fit in the third positioning concavity 53.

On the other hand, a corner of the female housing 50 could advance into the hood 12 deeper than other portions if the female housing 50 is mounted into the hood 12 in an improper oblique posture. However, the first, second and third prevention pieces 61, 62 and 63 are disposed forward from the front ends of the tabs 22. Thus the corner of the female housing 50 does not contact the front ends of the tabs 22 and the tabs 22 will not be damaged by the female housing 50.

The first and second prevention pieces 61 are disposed in the region of the rear-end surface of the hood from which the tabs project and are spaced in a row to prevent the female housing 50 from interfering with the tabs 22. The two second prevention pieces 62 sandwich the first prevention piece 61 therebetween. Tabs 22 are disposed between the first prevention piece 61 and the left and right second prevention pieces 62. This construction allows some of the tabs 22 to be disposed in the region where the prevention part is formed, thereby decreasing the tab-disposing region and the connector is smaller than if the prevention part was continuous.

The second prevention piece 62 is formed integrally with the inner peripheral surface of the hood part 12. Thus, the second prevention piece 62 has a high rigidity and there is no fear that the second prevention piece 62 will deform in response to a pressing force applied by the mating connector.

The corner of the female connector F advances deeper into the hood 12 than other portions of the female connector F and is disposed at the central region of the hood 12 if the female connector F is advanced into the hood 12 in an inclined posture. However, part of the first prevention piece 61 is in the central position of the hood part 12 in the direction in which the first and second prevention pieces 61 and 62 are arranged. Thus it is possible to restrain the advance distance of the female connector F into the hood 12 to a possible smallest extent.

The first prevention piece 61 is a plate that projects from the central region of the hood 12, and there is a fear that the first prevention piece 61 lack rigidity. But the rigidity of the first prevention piece 61 is enhanced by forming the reinforcing rib 64 thereon. Therefore it is possible to prevent the female connector F from advancing into the hood 12 in an improper posture.

The third prevention piece 63 is spaced vertically from the first and second prevention pieces 61 and 62 in a direction intersecting the left-to-right direction in which the first and second prevention pieces 61 and 62 are arranged. This construction prevents the female connector F from advancing into the hood 12 in the improper posture. The third prevention piece 63 is in the region that includes the central position of the hood 12 in the direction in which the first prevention piece 61 and the second prevention piece 62 are arranged. This construction reliably prevents the advance of the female connector into the hood 12.

The tabs 22 are disposed between the third prevention piece 63 and the inner peripheral surface of the hood 12. Therefore, it is possible to decrease the disposing region of other tabs 22.

The third prevention piece 63 is a plate that projects in the central region of the hood 12, and there is a fear that the first prevention piece 61 lack rigidity. However, the rigidity of the third prevention piece 63 is enhanced by the reinforcing rib 64. Therefore it is possible to prevent the female connector F from advancing into the hood 12 in an improper posture.

In fitting the female connector F in the male connector M, the female connector F will incline with respect to the hood 12 about the rotational center of the lever 40. However, the first and third prevention pieces 61 and 63 are spaced in the vertical direction perpendicular to the rotational center of the lever 40 (the direction in which the first and third prevention pieces 61 and the 63 are arranged is perpendicular to the rotational axis of the lever 40). Therefore the first and third prevention pieces 61 and 63 securely prevent the female connector F from inclining.

The front retainer 30 for preventing the removal of the male terminal fitting 20 is mounted on the front-end surface of the terminal accommodation part 11. Additionally, the first and third prevention pieces 61 and 63 are formed integrally with the front retainer 30. Therefore, the construction of the invention is capable of simplifying the configuration of the male housing 10 (front surface of the terminal accommodation part 11) when compared with the construction in which the first and third prevention pieces are formed integrally with the front surface of the terminal accommodation part.

The invention is not limited to the above-described embodiment described above with reference to the drawings. For example, the following embodiments are included in the technical scope of the present invention.

The connector of the invention is applicable to not only a lever-type connector, but also a connector with no lever.

Tabs of the illustrated embodiment are in each of the tab-disposing spaces on opposite sides of the first prevention piece. However, one of these two tab-disposing spaces may have no tab.

The number of the tabs to be disposed between the first prevention piece and the second prevention piece is not limited to one, but to not less than two.

The illustrated embodiment has the same number of the tabs in the tab-disposing spaces between the first prevention piece and each of the left and right second prevention pieces. However, the number of tabs in these two tab-disposing spaces need not be equal.

One first prevention piece is provided in the illustrated embodiment. However, plurality first prevention pieces may be arranged side by side.

The second prevention piece may be formed separately from the hood. In this case, the second prevention piece may contact the inner peripheral surface of the hood or may be spaced from the inner peripheral surface thereof.

The first prevention piece of the illustrated embodiment is in the central position of the hood in the direction in which the first and second prevention pieces are arranged. However, the first prevention piece may be offset from the central position of the hood in the arranging direction of the first and second prevention pieces.

The third prevention piece may be omitted.

Reinforcing ribs may not be formed on the first and/or third prevention piece.

The first prevention piece may be formed on the front surface of the terminal accommodation part.

The third prevention piece may be formed on the front surface of the terminal accommodation part.

Front ends of the first and third prevention pieces may be offset longitudinally.

The front end of the first prevention piece may be longitudinally coincident with the open surface of the hood.

The front end of the third prevention piece may be longitudinally coincident with the open surface of the hood.

The front end of the second prevention piece may be disposed longitudinally rearward from the open surface of the hood.

What is claimed is:

1. A connector comprising:

a housing having a terminal accommodation part and a hood extending forward from the terminal accommodation part;

male terminal fittings held by the terminal accommodation part and having tabs projecting forward into the hood; and a first prevention piece and two second prevention pieces projecting forward in the hood and being arranged in a row, the first prevention piece being disposed between and spaced from the second prevention pieces, the second prevention pieces being integral with an inner peripheral surface of said hood;

wherein a plurality of the tabs are disposed between the first prevention piece and the second prevention pieces, and wherein the prevention pieces are disposed for preventing a mating connector that has advanced into the hood in an improper oblique posture from contacting the tabs.

2. A connector comprising:

a housing having a terminal accommodation part with cavities formed therein, lances projecting into the cavities and flexible spaces adjacent the lances for permitting deflection of the lances, a hood extending forward from the terminal accommodation part;

terminal fittings locked in the respective cavities by the lances, each of the terminal fittings having a tab projecting into the hood;

a retainer mounted in the hood the retainer having engaging pieces projecting into the flexible spaces for holding the lances in engagement with the terminal fittings;

a first prevention piece projecting forward from the retainer and into the hood; and two second prevention pieces projecting forward from the terminal accommodation part and into the hood on opposite respective sides of the first prevention piece, at least two of the tabs being disposed between the two second preventing pieces and on opposites respective sides of the first preventing piece, the prevention pieces being disposed and configured to prevent a mating connector that has advanced into the hood in an improper oblique posture from contacting the tabs.

3. The connector of claim 1, wherein the first prevention piece is disposed in a central position of the hood along the row in which the first and second prevention pieces are arranged.

4. The connector of claim 1, wherein the first prevention piece has a plate and at least one reinforcing rib projecting from the plate.

5. The connector of claim 1, further comprising a third prevention piece spaced from the row in which the first and second prevention pieces are arranged, the third prevention piece being in a central position of said hood in a direction parallel to the row in which the first and second prevention pieces are arranged.

6. The connector of claim 5, wherein at least one of the tabs is between the third prevention piece and an inner surface of said hood.

7. The connector of claim 6, wherein said third prevention piece is plate-shaped and has at least one reinforcing rib formed thereon.

8. The connector of claim 5, further comprising a lever mounted on the housing for rotation about an axis and configured for generating a cam action for urging the mating connector into the hood, the first and third prevention pieces projecting substantially perpendicular to the axis of rotation of the lever.

9. The connector of claim 5, further comprising a retainer mounted on a front surface of said terminal accommodation part and configured for preventing removal of said male terminal fittings, the first and third prevention pieces being integral with the retainer.

10. The connector of claim 1, further comprising a retainer mounted on a front surface of said terminal accommodation part and configured for preventing removal of said male terminal fittings, the first prevention piece being integral with the retainer.

11. A connector comprising:

a housing having a terminal accommodation part and a hood, the hood having a rear end at the terminal accommodation part and an open front end spaced from the terminal accommodation part;

spaced-apart prevention pieces projecting forward into the hood from positions in proximity to the rear end of the hood the prevention pieces include a first prevention piece spaced inwardly from the hood and two second prevention pieces formed unitarily with an inner peripheral surface of the hood, the first and second prevention pieces being aligned with one another along a linear arranging direction; and male terminal fittings held by the terminal accommodation part, the male terminal fittings having tabs projecting forward from the terminal accommodation part and into the hood, at least two of the tabs being disposed along the arranging direction on opposite sides of the first prevention piece and between the second prevention pieces, wherein the prevention pieces are disposed and configured for preventing a mating connector that has advanced into the hood in an improper oblique posture from contacting said tabs.

12. The connector of claim 2, wherein the first prevention piece is unitary with the retainer and the second prevention pieces are unitary with the hood.

13. The connector of claim 12, wherein the first and second prevention pieces are spaced apart along a linear arranging direction, a third prevention piece projecting unitarily forward from the retainer at a position spaced from the first and second prevention pieces in a direction intersecting the arranging direction, the third prevention piece being spaced inwardly from the hood, a plurality of the tabs being disposed between the first and third prevention pieces.

14. The connector of claim 11, further comprising a third prevention piece spaced from the first and second prevention pieces in a direction intersecting the arranging direction, said third prevention piece being spaced inwardly from said hood.

15. The connector of claim 14, wherein at least one of the tabs is between the third prevention piece and an inner surface of said hood.

16. The connector of claim 14, wherein the third prevention piece is plate-shaped and has at least one reinforcing rib formed thereon.

17. The connector of claim 11, wherein said first prevention piece includes a first plate and at least one reinforcing rib formed on the first plate.

* * * * *